US005232343A

United States Patent [19]

Butts

[11] Patent Number: 5,232,343

[45] Date of Patent: Aug. 3, 1993

[54] TURBINE BLADE

[75] Inventor: Don Butts, Swampscott, Mass.

[73] Assignee: General Electric Company, Cincinnati, Ohio

[21] Appl. No.: 581,263

[22] Filed: Sep. 12, 1990

Related U.S. Application Data

[63] Continuation of Ser. No. 613,543, May 24, 1984, abandoned.

[51] Int. Cl.[5] ..... F01D 5/18

[52] U.S. Cl. ..... 416/97 R; 415/115

[58] Field of Search ..... 416/95, 97 R, 96 R; 415/115, 116

[56] References Cited

U.S. PATENT DOCUMENTS

| | | | |
|---|---|---|---|
| 3,398,526 | 8/1968 | Olah | 60/740 X |
| 3,628,885 | 12/1971 | Sidenstick et al. | 416/97 R |
| 3,782,852 | 1/1974 | Moore | 416/97 R |
| 4,180,373 | 12/1979 | Moore et al. | 416/97 R |
| 4,236,870 | 12/1980 | Hucul, Jr. et al. | 416/97 R |
| 4,257,737 | 3/1981 | Andress et al. | 416/97 R |
| 4,292,008 | 9/1981 | Grosjean et al. | 415/115 |
| 4,416,585 | 11/1983 | Abdel-Messeh | 416/97 R |
| 4,474,532 | 10/1984 | Pazder | 416/97 R |
| 4,627,480 | 12/1986 | Lee | 164/369 |

FOREIGN PATENT DOCUMENTS

| | | | |
|---|---|---|---|
| 1410014 | 10/1975 | United Kingdom | 416/97 R |
| 2112467 | 7/1983 | United Kingdom | 416/97 R |
| 2112868 | 7/1983 | United Kingdom | 416/97 R |

OTHER PUBLICATIONS

Advanced Concepts in Small Helicopter Engine Air--Cooled Turbine Design by L. A. Bevilacqua and W. E. Lightfoot; dated Sep. 13-15, 1983; a 12-page technical paper.

*Primary Examiner*—John T. Kwon

*Attorney, Agent, or Firm*—Jerome C. Squillaro; Nathan D. Herkamp

[57] ABSTRACT

An exemplary preferred embodiment of the present invention includes a gas turbine blade having an internal coolant passage therein of width D and a plurality of longitudinally spaced substantially straight turbulator ribs having a height E disposed substantially perpendicularly to a longitudinal axis of the coolant passage. The ratio E/D is preferably within the range of about 0.07 and about 0.33 and the height E of the ribs being in the range of about 0.010 inches and about 0.025 inches. These features may be utilized in a relatively small blade, e.g., 1.0 inch, for obtaining enhanced cooling ability for operation in turbine gas temperatures greater than about 2,300 degrees F. without the need for conventional, relatively complex cooling structures required for larger blades.

21 Claims, 2 Drawing Sheets

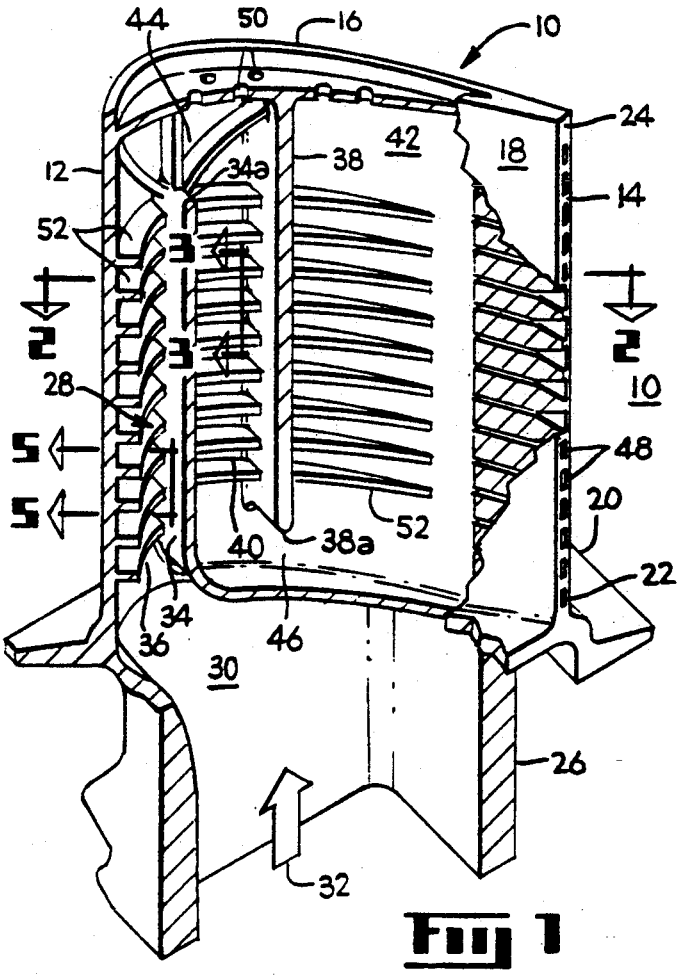
Fig 1
Fig 3
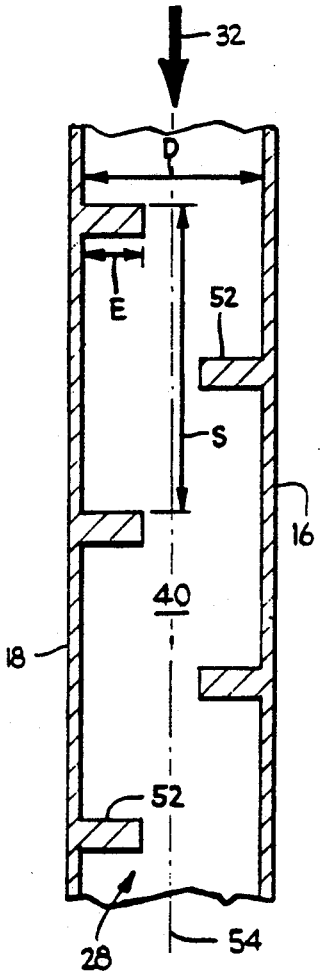
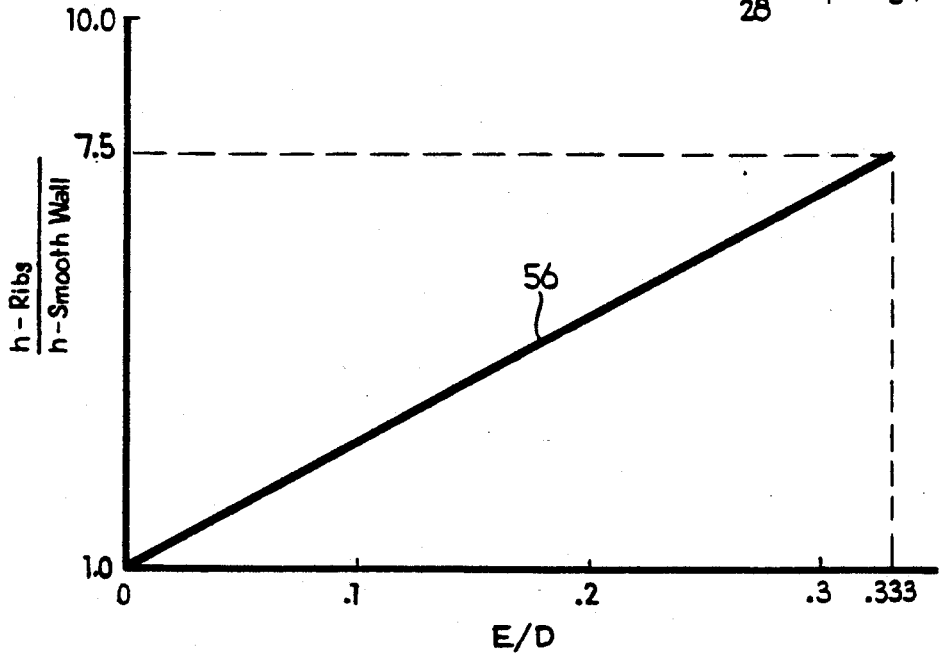
Fig 4

TURBINE BLADE

The Government has rights in this invention pursuant to Contract No. DAAK51-83-C-0014 awarded by the Department of the Army.

This is a continuation of application Ser. No. 06/613,543, filed May 24, 1984, now abandoned.

BACKGROUND OF THE INVENTION

The present invention relates generally to gas turbine engines and, more particularly, to coolable hollow turbine blades thereof.

The efficiency of a gas turbine engine is directly proportional to the temperature of turbine gases channeled through a high-pressure turbine nozzle from a combustor of the engine and flowable over turbine blades thereof. For example, for gas turbine engines having relatively large turbine blades, e.g., root-to-tip dimensions greater than about 1.5 inches, turbine gas temperatures approaching 2,700 degrees F. are typical. To withstand this relatively high gas temperature, these large blades are manufactured from known advanced materials and typically include known state-of-the-art type cooling features.

A turbine blade is typically cooled using a coolant such as compressor discharge air which is utilized in various structural elements for obtaining film, impingement, and/or convection cooling of the turbine blade. The blade typically includes a serpentine coolant passage and various cooling features such as turbulence promoting ribs, i.e. turbulators, extending from sidewalls of the blade into the serpentine passage to about 0.010 inches. Generally cylindrical pins may also be utilized and may extend partly or completely between opposing sidewalls of the blade in the serpentine passage.

The leading edge of a blade is typically the most critical portion thereof and special, relatively complex cooling features are used. For example, the leading edge typically includes leading edge cooling apertures which are effective for generating film cooling, or the serpentine passage at the leading edge may include impingement inserts for providing enhanced cooling, or the serpentine passage at the leading edge may include turbulators and pins for improving heat transfer.

Gas turbine engines which include relatively small turbine blades, e.g., less than about 1.5 inches from root to tip, have been unable to utilize many of the above described large blade cooling features because of their relatively small size and, therefore, these engines have been limited to about 2,300 degrees F. turbine gas temperature. It follows, therefore, that the small gas turbine engines have been unable to achieve the higher efficiency of operation associated with the higher turbine gas temperatures in the range of about 2,300 degrees F. to about 2,700 degrees F.

Accordingly, it is one object of the present invention to provide a turbine blade having new and improved cooling features.

It is another object of the present invention to provide small turbine blades with new and improved cooling features effective for withstanding turbine gas temperatures greater than about 2,300 degrees F.

Another object of the present invention is to provide a small turbine blade with cooling features having improved heat transfer coefficients.

Another object of the present invention is to provide a new and improved small turbine blade utilizing relatively simple and easily manufacturable cooling features.

SUMMARY OF THE INVENTION

An exemplary preferred embodiment of the present invention includes a gas turbine blade having an internal coolant passage therein of width D and a plurality of longitudinally spaced substantially straight turbulator ribs having a height E disposed substantially perpendicularly to a longitudinal axis of the coolant passage. The ratio E/D is greater than about 0.07 and is preferably within the range of about 0.07. In several preferred embodiments of the invention the E/D ratio is about 0.33 and the height E of the ribs being in the range of about 0.010 inches and about 0.025 inches.

BRIEF DESCRIPTION OF THE DRAWINGS

The novel features believed characteristic of the invention are set forth in the appended claims. The invention, itself, together with further objects and advantages thereof is more particularly described in the following detailed description taken in conjunction with the accompanying drawings in which:

FIG. 1 is a sectional isometric view of a gas turbine blade according to one embodiment of the present invention.

FIG. 3 is a longitudinal sectional view of the turbine blade of FIG. 1 taken along line 3—3.

FIG. 4 is a graph indicating convection heat transfer coefficient of the turbulator ribs illustrated in FIG. 3 with respect to the heat transfer coefficient of a smooth wall plotted against the ratio E/D.

DETAILED DESCRIPTION

Figure 2:
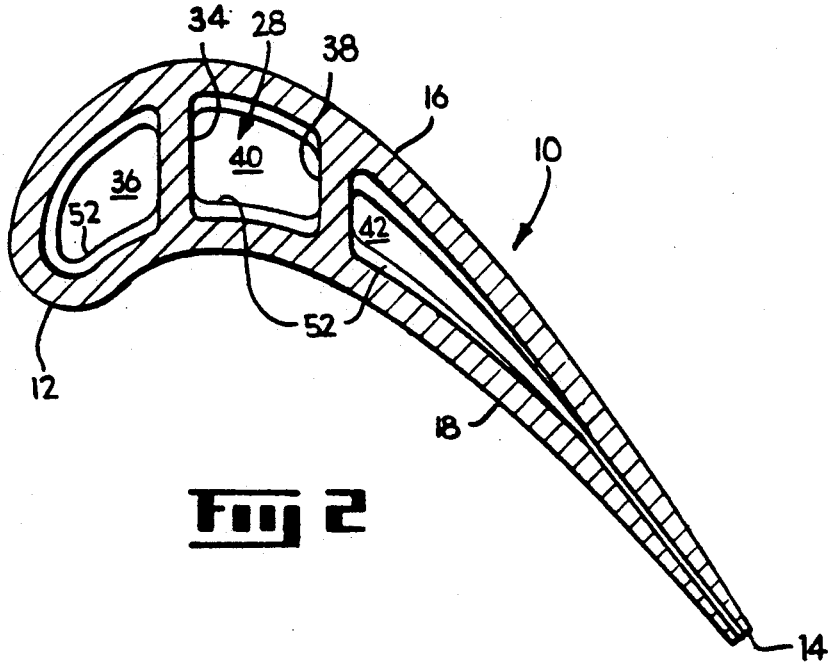
FIG. 2 is a transverse sectional view of the turbine blade of FIG. 1 taken along line 2—2.

Illustrated in FIGS. 1 and 2 is an exemplary turbine blade 10 for use in a gas turbine engine. The blade 10 includes a leading edge 12, and a trailing edge 14 and first and second sidewalls 16 and 18, respectively, extending therebetween. The first sidewall 16 is generally convex in profile and defines a suction side of the blade 10. The second sidewall 18 is generally concave in profile and defines a pressure side of the blade 10.

The blade 10 further includes a platform 20 disposed at a root 22 of the blade 10. The blade 10 also includes a tip 24. Relatively hot turbine gases received from a combustor of the gas turbine engine are channeled through a high-pressure turbine nozzle (all not shown) and flow over the blade 10 from the tip 24 to the root 22, the platform 20 being incorporated for defining a radially inner boundary of the turbine gas flow. The blade 10 also includes a dovetail 26 for mounting the blade 10 to a rotor disk of the gas turbine engine (not shown) in a conventional manner.

According to one embodiment of the present invention, the blade 10 further includes a preferably serpentine coolant passage 28 disposed between the first and second sidewalls 16 and 18 which is effective for channeling a coolant through the blade 10 for the cooling thereof. The coolant passage 28 includes a single inlet 30 disposed in the dovetail 26 through which a coolant 32, such as air received from a compressor of the gas turbine engine (not shown), is received.

The blade 10 further includes a first partition 34 extending radially outwardly from the root 22 toward the tip 24. The first partition 34 extends between the first and second sidewalls 16 and 18 and is spaced from the leading edge 12 and the tip 24. The first partition 34 and the first and second sidewalls 16 and 18, between the first partition 34 and the leading edge 12, are imperforate and define a first portion, i.e., leading edge passage 36, of the serpentine coolant passage 28.

The blade 10 also includes a second partition 38 which extends radially inwardly from the tip 24 toward the root 22. The second partition 38 extends between the first and second sidewalls 16 and 18 and is spaced from the trailing edge 14, the first partition 34, and the root 22. The first partition 34, the second partition 38, and the first and second sidewalls 16 and 18 define therebetween a second portion of the coolant passage 28, i.e., midchord passage 40. The second partition 38, the trailing edge 14, and the first and second sidewalls 16 and 18 define therebetween a third portion of the coolant passage 28, i.e., trailing edge passage 42.

The first passage 36 and the second passage 40 are in flow communication with each other through a first bend channel 44 defined between the tip 24 and a radially outer end 34*a* of the first partition 34, and between the second partition 38, the leading edge 12, and the sidewalls 16 and 18. The second passage 40 and the third passage 42 are in flow communication with each through a second bend channel 46 defined between a radially inner end 38*a* of the second partition 38 and between the trailing edge 14, the first partition 34 at the root 22, and between the first and second sidewalls 16 and 18.

The blade 10 also includes a plurality of trailing edge apertures 48 disposed in the trailing edge 14 and being in flow communication with the trailing edge passage 42. A plurality of tip cooling apertures 50 are disposed in the tip 24 and are in flow communication with the first bend channel 44 and the third passage 42.

In operation, coolant 32 enters the serpentine coolant passage 28 through the inlet 30 and flows in turn through the first passage 36, the first bend channel 44, the second passage 40, the second bend channel 46, the third passage 42, and out through the trailing edge apertures 48. More specifically, 100 percent of the coolant which enters the inlet 30 flows through the leading edge passage 36. Primarily 100 percent of the coolant 32 then continues to flow through the second passage 40 to the third passage 42 and out the trailing edge apertures 48. A relatively small portion of the coolant 32, e.g. 15-20%, is discharged from the first bend channel 44 and the third passage 42 through the tip apertures 50 to provide enhanced cooling of the tip 24.

The blade 10 is effective, for example, for use in a small gas turbine engine having turbine gas temperatures greater than about 2,300 degrees F. and up to about 2,700 degrees F. The length of the blade 10 from the root 22 to the tip 24 is less than about 1.5 inches and in this embodiment is about 1.0 inch. The blade 10 is manufactured from conventional high-temperature materials or superalloys.

In order to provide effective cooling of the blade 10 within this high-temperature environment, a plurality of turbulator ribs 52 in accordance with the present invention are provided in the coolant passage 28. The turbulator ribs 52 as illustrated in FIGS. 1, 2 and 3 are preferably substantially straight and longitudinally spaced. They extend substantially perpendicularly outwardly from both sidewalls 16 and 18 and are disposed substantially perpendicularly to the direction of flow of the coolant 32 as represented by a longitudinal axis 54 of the coolant passage 28.

As illustrated more particularly in FIG. 3, each of the ribs 52 has a height E, and with respect to a width D defined between the sidewalls 16 and 18 of the coolant passage 28 define a ratio E/D having a value greater than about 0.07. The ribs 52 of the sidewall 16 are preferably staggered and equidistantly spaced between the ribs 52 of the sidewall 18.

Turbulator ribs are conventionally known in the art, however, they typically have an E/D ratio of less than about 0.07. This is due to several reasons. For example, it is known that turbulator ribs are effective for enhancing conventionally known convection heat transfer coefficients. However, the height E of a turbulator rib is directly proportional to the pressure drop experienced through a flow channel having such ribs. Furthermore, although a turbulator rib provides turbulence for enhancing heat transfer, too large a turbulator results in flow separation on the downstream side of the rib which substantially reduces or eliminates the convection heat transfer. Accordingly, to avoid substantial pressure drops due to turbulator ribs and to reduce the possibility of flow separation, conventional turbulator ribs typically have an E/D ratio of less than about 0.07 and also utilize ribs having a height E of about 0.010 inch.

According to the present invention, test results have indicated that the use of the turbulator rib 52 having a height E from about 0.010 inches to about 0.025 inches and an E/D ratio of about 0.07 to about 0.333 results in a substantial increase in the convection heat transfer coefficient. Although the preferred ribs 52 provide a substantial partial blockage of the coolant 32 (for example, in the view as illustrated in FIG. 3, up to about 67 percent of the flow area in the coolant passage 28 may be blocked, and, therefore, results in increased pressure drop through the coolant passage 28), this undesirable feature is more than offset by ribs 52.

More specifically, illustrated in FIG. 4 is graph indicating the increased amount of convection heat transfer realizable from the turbulator ribs 52 according to the present invention. The abscissa of the graph indicates the E/D ratios and the ordinate indicates the convection heat transfer coefficient of the turbulator ribs 52, i.e, h - Ribs, divided by the convection heat transfer coefficient of a smooth wall, i.e., h - Smooth Wall. The relative convection heat transfer curve 56 is based on tests conducted on an arrangement similar to that shown in FIG. 3. The curve 56 includes data points for E/D ratios of 0.15 and 0.333. Adjacent ribs 52 are spaced at a distance S, and the curve 56 includes data points for S/E values of 5.0 and 10.0. The curve 56 indicates that for an E/D ratio of 0.333 a relative convection heat transfer ratio of about 7.5 results.

Accordingly, it will be appreciated that the turbine blade 10 constructed in accordance with the present invention results in a relatively simple and manufacturable blade. The blade 10 does not require the relatively complex arrangements known in the prior art, and including, for example, leading edge film cooling apertures. The blade 10 has a substantial convection heat transfer capability effective for allowing the blade 10 to be operated subject to turbine gas temperatures greater than about 2,300 degrees F., and for a blade having a root to tip length of about only 1.0 inch.

Referring again to FIGS. 1 and 2, it will be appreciated that the ribs 52 extend along substantially the entire length of the sidewalls 16 and 18 between the leading edge 12, the first partition 34, the second partition 38, and the trailing edge 14 in the coolant passage 28. Of course, it should be appreciated that the ribs 52 are tailored to individual design requirements and vary in height E from about 0.010 inches to about 0.025 inches, and the E/D ratio also varies from about 0.07 to about 0.333. A nominal height E of 0.020 inches is preferred, which, although about twice as large as conventional turbulator ribs, provides improved heat transfer without undesirable flow separation.

More specifically, FIGS. 1 and 2 illustrate that the ribs 52 extend continuously without interruption along the sidewalls 16 and 18 from the leading edge 12 to the first partition 34 in the leading edge passage 36. Furthermore, the ribs 52 in the midchord passage 40 extend continuously without interruption along the sidewalls 16 and 18 from the first partition 34 to the second partition 38. In the trailing edge passage 42, the ribs 52 extend continuously without interruption along the sidewalls 16 and 18, and have a height decreasing in value, from the second partition 38 to about the aft end of the trailing edge passage 42 at the upstream end of trailing edge appertures 48.

Of course, the height E of the ribs 52 must accordingly be tailored, as illustrated in FIG. 2 for example, to account for the different structures of the leading edge passage 36, the midchord passage 40, and the trailing edge passage 42. In the particular embodiments of the invention illustrated in FIG. 2, the ribs 52 disposed in the leading edge passage 36 extend forward along both sidewalls 16 and 18 from the first partition 34 and intersect with each other at the leading edge 12. At the leading edge 12, itself, the ribs 52 have a height as measured perpendicularly from the inner surface of the sidewalls 16 and 18, which is generally the same at the leading edge 12 and along both sides immediately adjacent thereto. At the leading edge 12, itself, the E/D ratio of the portions of each of the ribs 52, which extend from both sidewalls 16 and 18 and which join with each other, may be considered to have a value of 1.0. And, the E/D ratio of the portions of the ribs 52 disposed away from the leading edge 12 in the leading edge passage 36 illustrated in FIG. 2 has values less than 1.0. Accordingly, in the embodiment of the invention illustrated in FIG. 2, the E/D ratio for the ribs 52 disposed in the leading edge passage 36 may range from about 0.07 to 1.0.

In the midchord passage 40 illustrated in FIG. 2, the width thereof and the height of the ribs 52 are generally uniform, the passage 40 decreasing slightly in width in the aft direction as illustrated, which results in a generally uniform E/D ratio along the entire length of the ribs 52 therein.

In the trailing edge passage 42, the height E of the ribs 52 has a maximum value at the second partition 38 and decreases to a minimum value near the aft end of the trailing edge passage 42. The trailing edge passage 42 decreases in width D from the second partition 38 to the aft portion thereof. In accordance with the embodiment of the invention having an E/D range between 0.07 and 0.333, E/D ratios of the ribs 52 within this range may be utilized in the trailing edge passage 42.

Figure 5:
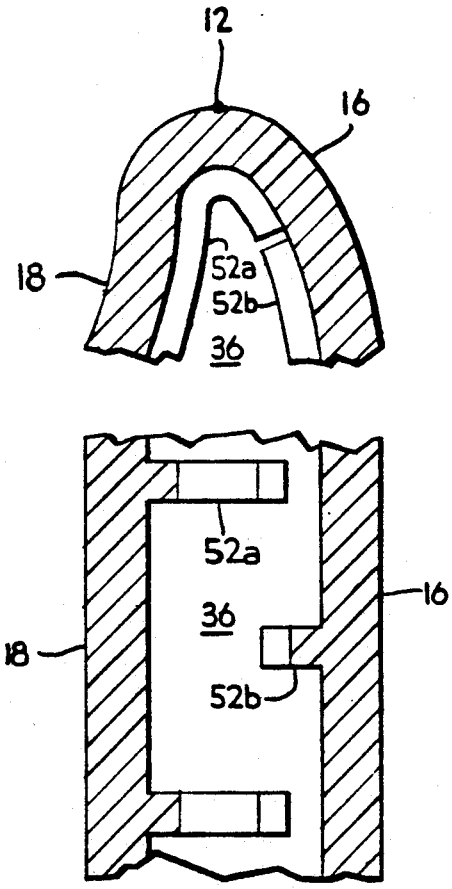
FIG. 5 is a sectional view illustrating a leading edge region of the turbine blade of FIG. 1 taken along line 5—5.
Figure 6:
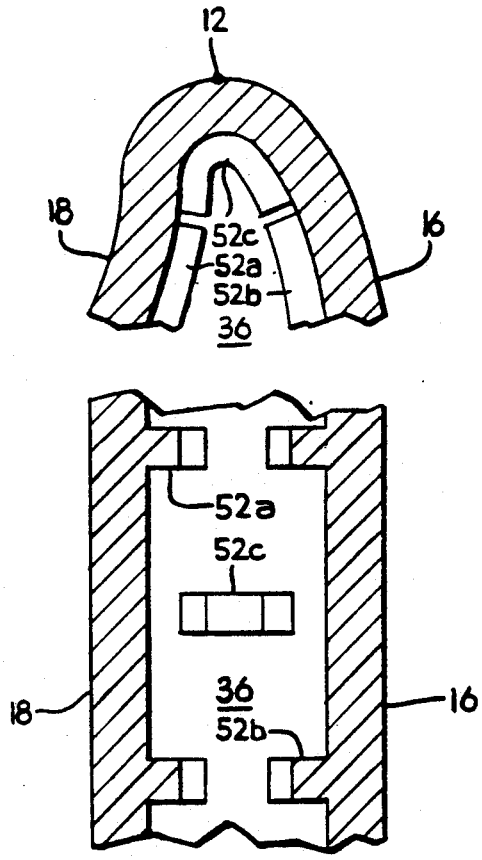
FIG. 6 is a sectional view of an alternate leading edge region of the turbine blade of FIG. 1 taken along line 5—5.

Inasmuch as the leading edge 12 of the blade 10 is a known critical region subject to some of the hottest temperatures of the blade 10, alternative preferred arrangements of the ribs 52 which provide improved heat transfer capability in the leading edge passage 36 are illustrated in FIGS. 5 and 6. FIG. 5 illustrates an embodiment of the leading edge passage 36 wherein the ribs 52 comprise leading edge first ribs **52*a* which extend from the first partition 34 along the second sidewall 18 to generally the leading edge 12. Leading edge second ribs 52*b* extend from the first partition 34 along the first sidewall 16 to meet an end of the first rib 52*a*. The first rib 52*a* and the second rib 52*b*** are staggered or equidistantly spaced with respect to each other.

Illustrated in FIG. 6 is an alternative embodiment of the leading edge passage 36. Similarly, the first ribs **52*a* extend to generally the leading edge 12, and the second ribs 52*b* also extend generally to the leading edge 12. Leading edge third ribs 52*c* are also provided and extend between the first and second ribs 52*a* and 52*b* along both the first and second sidewalls 16 and 18 at the leading edge 12. The first and second ribs 52*a* and 52*b* are preferably aligned with each other at a common radius, and the third ribs 52*c* are staggered and equidistantly spaced between the first and second ribs 52*a* and 52*b***.

In both embodiments illustrated in FIGS. 5 and 6, the ribs 52 (i.e. ribs **52*a* and ribs 52*c*, respectively) each have a portion which extends across both sides of the leading edge 12 along both sidewalls 16 and 18. As described above with respect to the ribs 52 in the leading edge passage 36 illustrated in the FIG. 2 embodiment, the ribs 52*a* and ribs 52*c* similarly have E/D ratios of 1.0 at the leading edge 12, itself, where the ribs 52 extending along the sidewalls 16 and 18** join together.

While there have been described herein what are considered to be preferred embodiments of the invention, other modifications will occur to those skilled in the art from the teachings herein. For example, although a blade 10 including a serpentine coolant passage 28 comprising first, second and third passages 36, 40 and 42, respectfully, is disclosed, a blade 10 including only two passages may also be used. The second passage 40 would merely be in direct flow communication with the trailing edge apertures 48 without the use of the second partition 38. Furthermore, although the use of staggered ribs 52 as shown in FIG. 3 are disclosed, ribs 52 on sidewalls 16 and 18 being radially aligned with each other, might also be used. Although ribs 52 disposed on both sidewalls 16 and 18 are disclosed, improved heat transfer capability may also result from the use of turbulator ribs 52 on only one sidewall. Of course, the invention is not limited to use in small turbine blades, but may be used in larger blades as well. It was conceived for small blades for providing improved cooling capability with relatively simple and easily manufacturable features.

Having thus described the invention, what is claimed as novel and desired to be secured by Letters Patents of the United States is:

1. A blade for use in a gas turbine engine comprising: leading and trailing edges and first and second sidewalls extending therebetween, said sidewalls defining a coolant passage having a width D extending between said first and second sidewalls for channeling coolant therethrough in a direction substantially parallel to a longitudinal axis thereof, one of said sidewalls including a plurality of longitudinally spaced substantially straight turbulator ribs disposed substantially perpendicularly to said longitudinal axis in said coolant passage, each of said ribs having a height E and the radio E/D being greater than about 0.07; and further including a root and a first partition extending therefrom and wherein said coolant passage comprises a serpentine passage defined by said first partition and said sidewalls and includes a first passage extending along said leading edge and a second passage disposed substantially parallel to and in flow communication with said first passage, said ribs extending from said partition along both said first and second sidewalls to said leading edge in said first passage and from said first partition along both said first and second sidewalls in said second passage.

2. A blade according to claim 1 wherein said ribs in said first passage comprise leading edge first ribs extending from said first partition along said first sidewall to generally said leading edge, and leading edge second ribs each extending from said first partition along said second sidewall to meet an end of one of said first ribs, said first and second ribs being staggered with respect to each other.

3. A blade according to claim 1 wherein said ribs in said first passage comprise leading edge first ribs extending from said first partition along said first sidewall to generally said leading edge, and leading edge second ribs extending from said first partition along said second sidewall to generally said leading edge, and leading edge third ribs extend between said first and second ribs along both said first and second sidewalls at said leading edge, said first and second ribs being aligned with each other and said third ribs being staggered with respect to said first and second ribs.

4. A blade according to claim 1 wherein said first and second sidewalls and said first partition defining said first passage are imperforate and said first passage is effective for channeling primarily 100 percent of coolant flowable therethrough to said second passage.

5. A blade according to claim 1 further including a tip and a second partition extending therefrom, said serpentine passage further including a third passage defined by said second partition and said sidewalls and disposed substantially parallel to said trailing edge and in flow communication with said second passage, said second passage being defined by said first and second partitions and said sidewalls, said ribs in said second passage extending from said first partition to said second partition, and said third passage also including said ribs extending from said second partition along portions of both said first and second sidewalls toward said trailing edge.

6. A blade according to claim 5 further including trailing edge apertures and wherein said first and second passages are effective for channeling primarily 100 percent of coolant flowable therethrough to said third passage and out said trailing edge apertures.

7. A blade according to claim 6 wherein said tip includes tip apertures in flow communication with said second and third passages.

8. A blade according to claim 1 further including a tip, said first partition extending from said root between said sidewalls toward said tip, and a second partition extending from said tip between said sidewalls toward said root, said first and second partitions being spaced from each other and from said leading and trailing edges for defining said serpentine coolant passage including said first passage extending along said leading edge, said second passage extending between said first and second partitions and being in flow communication with said first passage and a third passage disposed between said second partition and said trailing edge and being in flow communication with said second passage, said first and second sidewalls each including a plurality of said longitudinally spaced substantially straight turbulator ribs disposed substantially perpendicularly to said longitudinal axis in said serpentine passage.

9. A blade according to claim 8 wherein said first, second and third passages each includes ribs extending therein from said sidewalls and said ribs in said second passage have an E/D ratio within a range of about 0.07 and 0.333.

10. A blade according to claim 9 wherein said ribs disposed in said first passage extend from said first partition along both said first and second sidewalls to said leading edge.

11. A blade according to claim 8 wherein said ribs of said first sidewall in said second passage are staggered with respect to said ribs of said second sidewall.

12. A blade according to claim 8 wherein said ribs disposed in said first passage comprise leading edge first ribs extending from said first partition along said first sidewall to generally said leading edge, and leading edge second ribs extending from said first partition along said second sidewall to said first ribs, said first and second ribs being staggered with respect to each other.

13. A blade according to claim 8 wherein the distance of said blade from said root to said tip is about one inch.

14. A blade according to claim 8 wherein said height E is about 0.020 inches and said ribs are longitudinally spaced a distance S from each other, the ratio S/E being in the range of about 5.0 and about 10.0.

15. A blade according to claim 2 wherein said second ribs have an E/D ratio within a range of about 0.07 and about 0.333, and each of said first ribs has a portion extending along both said first and second sidewalls at said leading edge, said first ribs having an E/D ratio of 1.0 at said portion at said leading edge and E/D ratios less than 1.0 at portions away from said leading edge.

16. A blade according to claim 3 wherein each of said first and second ribs has an E/D ratio within a range of about 0.07 and about 0.333, and said third ribs have an E/D ratio of 1.0 at said leading edge.

17. A blade according to claim 5 wherein said ribs in said second passage have an E/D ratio within a range of about 0.07 and about 0.333.

18. A blade for use in a gas turbine engine comprising:

leading and trailing edges and first and second sidewalls extending therebetween, said sidewalls defining a coolant passage having a width D extending between first and second sidewalls for channeling coolant therethrough in a direction substantially parallel to a longitudinal axis thereof, each of said sidewalls including a plurality of longitudinally spaced substantially straight turbulator ribs disposed substantially perpendicularly to said longitudinal in said coolant passage, each of said ribs having a height E and the ratio E/D being greater than about 0.07; and said ribs being longitudinally spaced a distance S from each other and the ratio S/E being in the range of about 5.0 and about 10.0; and a root and a first partition extending therefrom and wherein said coolant passage comprises a passage extending along said leading edge, and wherein said ribs comprise leading edge first ribs extending from said first partition along said first sidewall to generally said leading edge, and leading edge second ribs each extending from first partition along said second sidewall to meet an end of one of said first ribs, said first and said second ribs being staggered with respect to each other.

19. A blade for use in a gas turbine engine comprising: leading and trailing edges and first and second sidewalls extending therebetween, said sidewalls defining a coolant passage having a width D extending between first and second sidewalls for channeling coolant therethrough in a direction substantially parallel to a longitudinal axis thereof, each of said sidewalls including a plurality of longitudinally spaced substantially straight turbulator ribs disposed substantially perpendicularly to said longitudinal axis in said coolant passage, each of said ribs having a height E and the ratio E/D being greater than about 0.07; and said ribs being longitudinally spaced a distance S from each other and the ratio S/E being in the range of about 5.0 and about 10.0; and a root and a first partition extending therefrom and wherein said coolant passage comprises a passage extending along said leading edge, and wherein said ribs comprise leading edge first ribs extending from said first partition along said first sidewall to generally said leading edge, and leading edge second ribs extending from first partition along said second sidewall to generally said leading edge, and leading edge third ribs extending between said first and second ribs along both said first and second sidewalls at said leading edge, said first and said second ribs being aligned with each other and said third ribs being staggered with respect to said first and second ribs.

20. A blade according to claim 18 wherein said first and second sidewalls and said first partition defining said first passage are imperforate.

21. A blade according to claim 20 wherein said first and second sidewalls and said first partition defining said first passage are imperforate.

* * * * *